US005438774A

United States Patent [19]

Fletcher et al.

[11] Patent Number: 5,438,774

[45] Date of Patent: Aug. 8, 1995

[54] MECHANICALLY ATTACHED ADAPTER

[75] Inventors: Rodney D. Fletcher, Peoria; David P. Cressy, Chillicothe, both of Ill.

[73] Assignee: Caterpillar Inc., Peoria, Ill.

[21] Appl. No.: 132,268

[22] Filed: Oct. 6, 1993

[51] Int. Cl.[6] ..... E02F 9/28

[52] U.S. Cl. ..... 37/456; 37/455; 172/772

[58] Field of Search ..... 172/719, 772, 772.5; 37/446, 452, 455, 456, 458

[56] References Cited

U.S. PATENT DOCUMENTS

| | | | |
|---|---|---|---|
| 1,395,048 | 10/1921 | McKee | 37/452 |
| 1,485,434 | 3/1924 | Seal | 37/455 |
| 3,455,040 | 7/1969 | Ratkowski | 37/456 |
| 3,621,594 | 11/1971 | Hahn et al. . | |
| 3,664,044 | 5/1972 | Hahn . | |
| 4,056,893 | 11/1977 | Willard . | |
| 4,187,035 | 2/1980 | Colburn | 37/458 |
| 4,413,432 | 11/1983 | Bierwith | 37/456 |
| 4,716,667 | 1/1988 | Martin | 172/772 |
| 4,748,754 | 6/1988 | Schwappach . | |
| 4,782,607 | 11/1988 | Frisbee et al. . | |
| 4,980,980 | 1/1991 | Schadov et al. | 37/452 |
| 5,077,918 | 1/1992 | Garman . | |

*Primary Examiner*—David H. Corbin
*Assistant Examiner*—Spencer Warnick
*Attorney, Agent, or Firm*—J. W. Burrows

[57] ABSTRACT

Mechanically attached adapters are beneficial in cutting edge assemblies for the ease of assembly and disassembly. However, they must be easily assembled and disassembled and must be able to withstand harsh operating conditions. In the subject arrangement, a cutting edge assembly is provided including a base edge having a stop member solidly secured thereto spaced from a leading edge thereof and extending upwardly from the base edge. A mechanically attached adapter has a forward working end portion and a rearward end portion for securing the mechanically attached adapter to the base edge. The rearward end portion has an upper strap portion, a lower strap portion spaced from the upper strap portion and interconnected therewith by an intermediate portion to define a cavity. The upper strap portion has an elongate slot which receives the stop member during assembly. A portion of the base edge is received in the cavity and a retainer mechanism is disposed in the elongate slot spaced from the stop member. A generally flat wedge is frictionally disposed therein between the stop member and one end of the elongate slot to secure the mechanically attached adapter to the base edge. The subject arrangement provides a cutting edge assembly that is easily assembled and disassembled and can withstand harsh operating conditions.

16 Claims, 2 Drawing Sheets

MECHANICALLY ATTACHED ADAPTER

TECHNICAL FIELD

This invention relates generally to an adapter for connection to the base edge of an implement and more particularly to an adapter that is mechanically attached to the base edge of the implement.

BACKGROUND ART

Mechanically attached adapters are generally known in the art. In many applications, the adapter is bolted to the base edge of a bucket. In these applications, it is many times difficult to remove the bolts once the bucket has been exposed to normal use. Additionally, as the components increase in size, it is more difficult to get bolts large enough and/or to apply sufficient torque to properly tighten the bolts. Furthermore, the bottom of the bucket is subject to high wear, consequently, resulting in the nut and bolt-end being worn away prematurely allowing the adapter to come loose and fall off. In other applications, a C-shaped member is vertically inserted through slots in the upper and lower straps of the adapter and through the base edge and held in place with a wedge. In these applications, as noted above, the bottom of the bucket is subject to high wear resulting in the lower portion of the C-shaped member wearing prematurely allowing it to come loose resulting in the adapter falling off the bucket. In an edge protector arrangement, a member is welded to the top of a base plate and a rubber layered securing member is placed therein to secure the edge protector member to the base edge. In this arrangement, the rubber layered locking member is subject to premature failure when used in harsh environments and may prematurely fail or come out, thus, allowing the edge protector to come loose and fall off the base edge.

The present invention is directed to overcoming one or more of the problems as set forth above.

Disclosure of the Invention

In one aspect of the present invention, a mechanically attached adapter is provided and has a forward working end portion having a nose adapted to receive a tooth and a rearward end portion adapted for connection to a base edge of an implement. The rearward end portion has an upper strap portion of a predetermined length, a lower strap portion generally parallel to and spaced from the upper strap portion, an intermediate portion interconnecting the upper strap portion and the lower strap portion, and a cavity defined by the upper strap portion, the lower strap portion, and the intermediate portion. The upper strap portion has an upper surface, a substantially flat lower surface, and an elongate slot defined therein between the upper surface and the lower surface and generally perpendicular with the lower surface. The elongate slot is defined by a pair of generally parallel spaced apart side surfaces, a forward end surface, and a rearward end surface having a concave shape.

In another aspect of the present invention, a cutting edge assembly adapted for use on an implement is provided and includes a base edge, a mechanically attached adapter, a retainer mechanism, and a generally flat wedge. The base edge has a leading edge, an upper surface, a generally parallel lower surface, an elongate opening extending between the upper and lower surfaces spaced from and generally perpendicular with the leading edge. A stop member having a forward end surface and a rearward end surface is solidly secured in a portion of the elongate opening nearest the leading edge and extends outwardly from the upper surface of the base edge. The mechanically attached adapter has a forward working end portion and a rearward end portion having an upper strap of a predetermined length, a lower strap generally parallel to and spaced a predetermined distance from the upper strap portion and operative to slidably receive the base edge therebetween, and an intermediate portion interconnecting the upper strap portion and the lower strap portion. The upper strap portion has an upper surface, a substantially flat lower surface, and an elongate slot defined therein between the upper surface and the lower surface and generally perpendicular with the lower surface. The elongate slot is defined by a pair of generally parallel spaced apart side surfaces having a space sufficient to slidably receive the stop member of the base edge, a forward end surface disposed adjacent the forward end surface of the stop member, and a rearward end surface spaced from the rearward end surface of the stop member. The retainer mechanism is slidably disposed in the elongate slot and in mating engagement with the rearward end surface of the elongate slot and spaced from the rearward end surface of the stop member. The generally flat wedge has a first force transferring surface and an opposed second force transferring surface oriented at an acute angle with respect to the first force transferring surface and is frictionally disposed in the elongate slot between the rearward end surface of the stop member and the retainer mechanism.

In yet another aspect of the present invention, a method of mounting a mechanically attached adapter to a base edge is provided. The adapter has an upper strap portion with an elongate slot defined therein, a spaced apart bottom strap and an intermediate portion interconnecting the upper strap and the lower strap portion to define a cavity. The base edge has a top surface, a leading edge, an elongate opening defined therein spaced from the leading edge, and a stop member solidly secured in the opening and extending outwardly from the top surface. The steps comprises lowering the adapter over the stop member of the base edge to insert the stop member into the elongate slot, sliding the mechanically attached adapter towards the leading edge to slip the base edge into the cavity, inserting a retainer mechanism into the elongate slot spaced from the stop member and abutting one end of the elongate slot, inserting a generally flat wedge into the elongate slot between the retainer mechanism and the stop member, and forcing the wedge into frictional engagement with the retainer mechanism and the stop member.

The present invention provides a mechanically attached adapter that is readily secured to the top of the base edge without requiring bolts extending through the base edge and/or other elements extending through the base edge that would be subject to wear and/or premature failure.

BEST MODE FOR CARRYING OUT THE INVENTION

Figure 1:
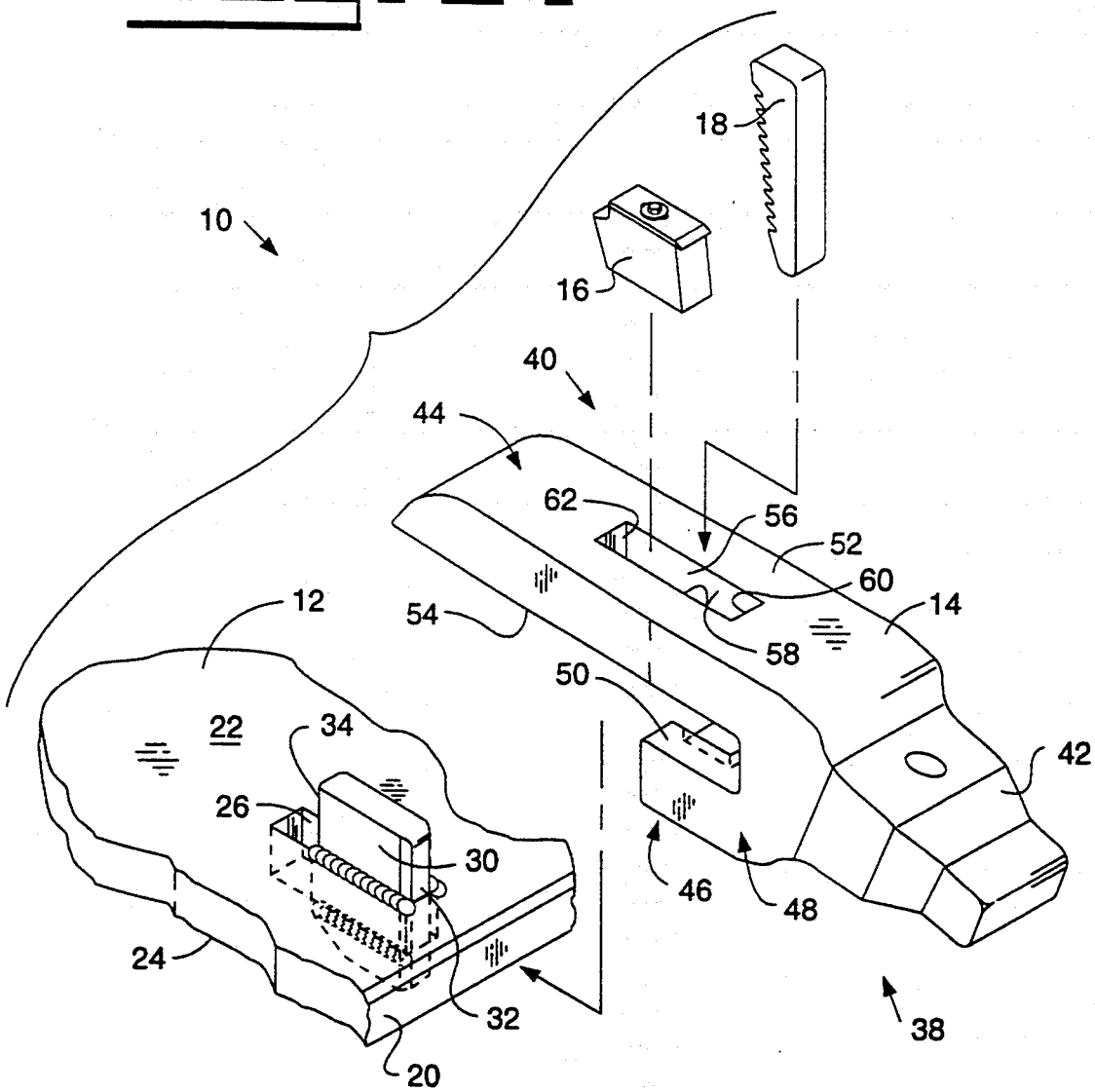
FIG. 1 is a diagrammatic representation of an embodiment of the present invention illustrating all elements in their unassembled condition.
Figure 2:
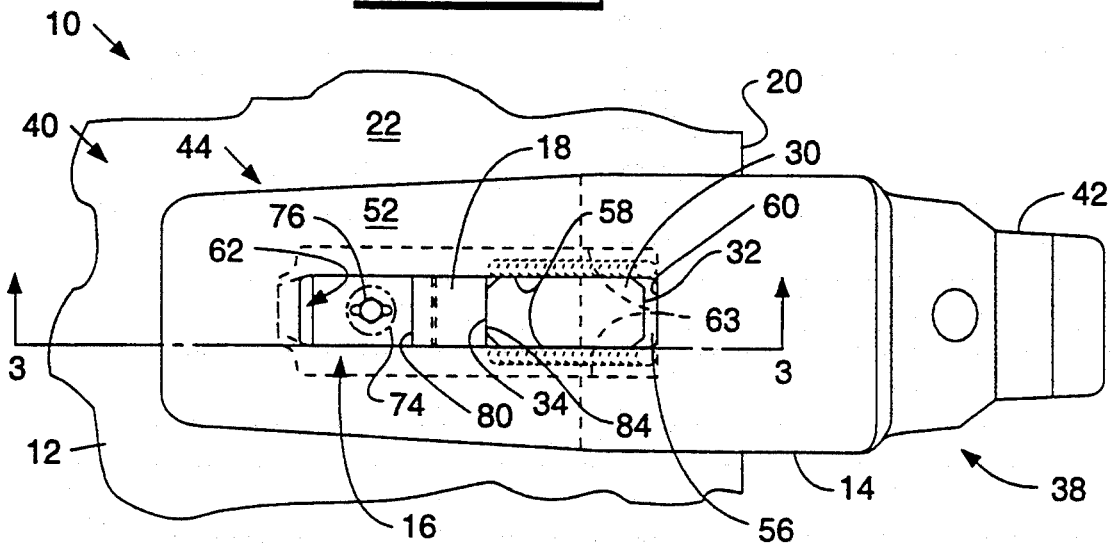
FIG. 2 is an elevational plan view with all components, illustrated in FIG. 1, in their assembled condition.
Figure 3:
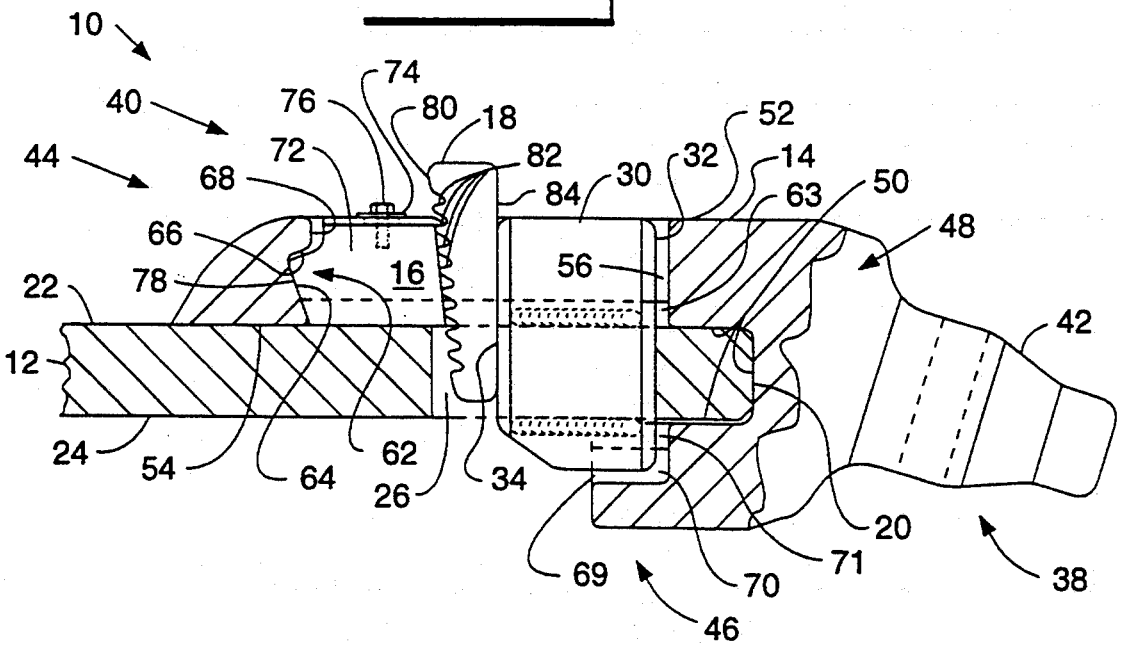
FIG. 3 is a side sectional view taken along the line 3—3 of FIG. 2 with a portion thereof shown in elevation.

Referring to the drawings, a portion of a cutting edge assembly 10 is shown and adapted for use on an implement (not shown). The cutting edge assembly 10 includes a portion of a base edge 12, a mechanically attached adapter 14, a retainer mechanism 16, and a generally flat wedge 18. The portion of the base edge 12 has a leading edge 20, an upper surface 22, a lower surface 24 generally parallel with the upper surface 22, and an elongate opening 26. The elongate opening 26 is spaced from the leading edge 20, extends between the upper surface 22 and the lower surface 24 and is oriented generally perpendicular to the leading edge 20. A stop member 30 is solidly secured in the elongate opening 26 and has a forward end surface 32 and a rearward end surface 34. The stop member 30 is positioned in the elongate opening 26 nearest the leading edge 20 and extends outwardly from the upper surface 22 of the base edge 12 and likewise extends outwardly from the lower surface 24 of the base edge 12. The stop member 30 is attached to the base edge 12 by welding along both sides of the stop member 30 to the upper surface 22 and along both side of the stop member 30 to the lower surface 24.

The mechanically attached adapter 14 has a forward working end portion 38 and a rearward end portion 40. As illustrated, the forward working end portion 38 has a nose 42 adapted to receive a ground engaging tooth (not shown). It is recognized that the forward working end portion 38 could be in the form of a tooth without departing from the essence of the invention.

The rearward end portion 40 has an upper strap portion 44 of a predetermined length, a lower strap portion 46, an intermediate portion 48, and a cavity 50 defined by the upper strap portion 44, the lower strap portion 46, and the intermediate portion 48. The intermediate portion 48 operatively interconnects the upper strap portion 44 and the lower strap portion 46.

The upper strap portion 44 has an upper surface 52, a substantially flat lower surface 54, and an elongate slot 56 defined therein between the upper surface 52 and the lower surface 54. The elongate slot 56 is generally perpendicular with the lower surface 54 and is defined by a pair of spaced apart side surfaces 58, a forward end surface 60, and a rearward end surface 62. A beveled surface 63 is defined along each surface of the pair of spaced apart side surfaces 58 adjacent the lower surface 54 of the upper strap portion 44.

The rearward end surface 62 of the elongate slot 56 has an irregular preestablished concave shape. The irregular concave shape is defined by a first generally flat surface 64 beginning at the lower surface 54 and extends upwardly and rearwardly towards the upper surface 52, a second generally flat surface 66 extends from the first flat surface 64 upwardly and forwardly towards the upper surface 52, and a third surface 68 extends from the second flat surface 66 upwardly to the upper surface 52.

The lower strap portion 46 has a predetermined length that is less than one-half the length of the upper strap portion 44 and is spaced from the upper strap portion 44. A recess 69 having side walls 70 is defined in the lower strap portion 46 at the end thereof and is of a size sufficient to receive a portion of the stop member 30. A beveled surface 71 is defined along the side walls 70 of the recess 69.

The retainer mechanism 16 is disposed in the elongate slot 56 spaced from the stop member 30 and includes a block member 72 and a removable clamp 74 secured thereto by a fastener 76. The block member 72 has a load transferring surface 78 in mating engagement with the rearward end surface 62 of the elongate slot 56.

The generally flat wedge 18 has a first force transferring surface 80 with a plurality of notches 82 disposed thereon in closely spaced relationship and a second force transferring surface 84 disposed at an acute angle with the first force transferring surface 80. The generally flat wedge 18 is frictionally disposed between the retainer mechanism 16 and the stop member 30 and secured therein by the removable clamp 74.

It is recognized that various forms of the cutting edge assembly 10 and the mechanically attached adapter 14 could be utilized without departing from the essence of the invention. For example, the rearward end surface 62 of the elongate slot 56 could be a concave surface having no flat surfaces or it could likewise be a flat surface extending between the upper surface 52 and the lower surface 54. Any change in the shape of the rearward end surface 62 of the elongate slot 56 requires, at least, a partial corresponding change in shape of the load transferring surface 78 of the block member 72. Furthermore, the stop member 30 would not have to extend outwardly from the lower surface 24 of the base edge 12. Even though it is preferred that a portion of the leading edge 20 of the base edge 12 engages the intermediate portion 48, it is recognized that the forward end surface 60 of the elongate slot 56 could engage the forward end surface 32 of the stop member 30 without departing from the essence of the invention. Additionally, the removable clamp 74 could have various shapes and/or engage the plurality of notches 82 of the generally flat wedge 18 in various positions. It is also recognized that the block member 72 could have teeth, protuberances or other retaining devices thereon in mating engagement with the generally flat wedge 18 in place of or in combination with the removable clamp 74.

Industrial Applicability

In the assembly and operation of the tooth assembly 10, the upper strap portion 44 of the mechanically attached adapter 14 is lowered over the stop member 30 in order for the stop member 30 to enter the elongate slot 56 until the lower surface 54 of the upper strap portion 44 engages the upper surface 22 of the base edge 12. The mechanically attached adapter 14 is slid in a direction so that the leading edge 20 of the base edge 12 enters the cavity 50 until the intermediate portion 48 contacts the leading edge 20. The retainer mechanism 16 is inserted into the elongate slot 56 adjacent the stop member 30 and moved in a direction so that the load transferring surface 78 thereof engages the first generally flat surface 64 of the rearward end surface 62. The generally flat wedge 18 is inserted into the elongate slot 56 between the stop member 30 and the retainer mechanism 16 and forced into frictional engagement therebetween. The bottom end of the generally flat wedge 18 normally extends into the elongate opening 26. It is recognized that the bottom end of the generally flat wedge 18 does not have to extend into the elongate opening 26. The force needed to frictionally engage the generally flat wedge 18 is transferred through the retainer mechanism 16 to the rearward end surface 62, thus, forcing the lower surface 54 of the upper strap portion 44 tightly against the upper surface 22 of the base edge 12. Simultaneously, the force acting against the rearward end surface 62 securely abuts the intermediate portion 48 against a portion of the leading edge 20. The removable clamp 74 is moved into engagement with at least one notch of the plurality of notches 82 of the generally flat wedge 18 and held in the engaged position by tightening the fastener 76. The removable clamp 74 is operative to maintain the generally flat wedge 18 in its frictionally engaged position.

After a tooth (not shown) is attached to the nose 42 of the mechanically attached adapter 14, the cutting edge assembly 10, with the tooth attached, is ready for operation. In-line horizontal forces acting on the nose 42 through the tooth is directed to the leading edge 20 through the intermediate portion 48. Vertical loads acting downwardly on the nose 42 through the tooth is directed to the base edge 12 through both the upper strap portion 44 and the intermediate portion 48. Forces acting upwardly on the bottom of the nose 42 through the tooth is directed to the base edge through both the lower strap portion 46 and the intermediate portion 48. Any side load forces acting on the nose 42 through the tooth is directed to the base edge 12 through the interface between the intermediate portion 48 and the mating portion of the leading edge 20 and through the respective surface of the pair of surfaces 58 to the stop member 30.

As is clear from a review of the drawings, the stop member 30 is firmly welded to the upper and lower surfaces 22,24 of the base edge 12 along both sides of the stop member 30. The beveled surfaces 63 adjacent the lower surface 54 of the upper strap portion 44 provides clearance for the welds along the upper surface 22 of the base edge 12 while the beveled surfaces 71 along the sidewalls 70 of the recess 69 of the lower strap portion 46 provides clearance for the welds along the lower surface 24 of the base edge 12.

The stop member 30 being firmly secured, by welding, in the elongate opening 26 of the base edge 12 provides an extremely strong support which is effective to counteract the high forces acting thereon during use. Furthermore, by having the retainer mechanism 16 and the generally flat wedge 18 oriented generally on the upper portion of the base edge 12, they are not subjected to extreme wear that results in their early failure and/or loosening which could allow the mechanically attached adapter 14 to fall off. Furthermore, the length of the lower strap portion 46 is effective to protect the bottom of the stop member 30 and, likewise, the bottom of the generally flat wedge 18 while still permitting assembly of the mechanically attached adapter 14 over the stop member 30.

A method of assembling the cutting edge assembly 10, as described above, comprises the steps of lowering the mechanically attached adapter 14 over the stop member 30 of the base 12 edge to insert the stop member 30 into the elongate slot 56, sliding the mechanically attached adapter 14 towards the leading edge 20 to slip the base edge 12 into the cavity 50, inserting the retainer mechanism 16 into the elongate slot 56 spaced from the stop member 30 and abutting one end of the elongate slot 56, inserting the generally flat wedge 18 into the elongate slot 56 between the retainer mechanism 16 and the stop member 30, and forcing the generally flat wedge 18 into frictional engagement with the retainer mechanism 16 and the stop member 30.

The method further includes the step of clamping the generally flat wedge 18 in its frictionally engaged position. Additionally, the step of inserting the generally flat wedge 18 into the elongate slot 56 also includes inserting the generally flat wedge 18 into the elongate opening 26.

In view of the foregoing, it is readily apparent that the subject cutting edge assembly 10 is easily assembled and disassembled and is effective to operate in extremely harsh operating conditions.

Other aspects, objects and advantages of this invention can be obtained from a study of the drawings, the disclosure and the appended claims.

What is claimed is:

1. A mechanically attached adapter, comprising:

a forward working end portion having a nose adapted to receive a tooth; and a rearward end portion adapted for connection to a base edge of an implement and having an upper strap portion of a predetermined length, a lower strap portion generally parallel to and spaced from the upper strap portion, an intermediate portion interconnecting the upper strap portion and the lower strap portion, and a cavity defined by the upper strap portion, the lower strap portion and the intermediate portion, the upper strap portion having an upper surface, a substantially flat lower surface, and an elongate slot defined therein between the upper surface and the lower surface and generally perpendicular with the lower surface, the elongate slot being defined by a pair of generally parallel spaced apart side surfaces, a forward end surface and a rearward end surface having a concave shape, said concave rearward end surface has a first generally flat surface beginning at the lower surface of the upper strap portion and extending upwardly and rearwardly toward the upper surface and a second surface extending from the first generally flat surface upwardly and forwardly toward the upper surface.

2. The mechanically attached adapter of claim 1 wherein the concave rearward end surface has a third surface extending from the second surface upwardly to the upper surface.

3. The mechanically attached adapter of claim 2 wherein the lower strap portion has a predetermined length that is less than one half the length of the upper strap portion.

4. A cutting edge assembly adapted for use on an implement, comprising:

a base edge having a leading edge, an upper surface, a generally parallel lower surface, an elongate opening extending between the upper and lower surfaces spaced from and generally perpendicular with the leading edge, a stop member having a forward end surface and a rearward end surface and being solidly secured in a portion of the elongate opening nearest the leading edge and extends outwardly from the upper surface of the base edge; and a mechanically attached adapter having a forward working end portion and a rearward end portion having an upper strap portion of a predetermined length, a lower strap portion generally parallel to and spaced a predetermined distance from the upper strap portion to slidably receive the base edge therebetween, and an intermediate portion interconnecting the upper strap portion and the lower strap portion, the upper strap portion having an upper surface, a substantially flat lower surface, and an elongate slot defined therein between the upper surface and the lower surface and generally perpendicular with the lower surface, the elongate slot being defined by a pair of generally parallel spaced apart side surfaces having a space sufficient to slidably receive the stop member of the base edge, a forward end surface disposed adjacent the forward end surface of the stop member, and a rearward end surface spaced from the rearward end surface of the stop member;

a retainer mechanism slidably disposed in the elongate slot and in mating engagement with the rearward end surface of the elongate slot and spaced from the rearward end surface of the stop member; and a generally flat wedge having a first force transferring surface and an opposed second force transferring surface oriented at an acute angle with respect to the first force transferring surface and frictionally disposed between the rearward end surface of the stop member and the retainer mechanism and being positioned in the elongate slot.

5. The cutting edge assembly of claim 4 wherein a portion of the leading edge of the base edge is in abutting contact with the intermediate portion of the mechanically attached adapter between the upper strap portion and the lower strap portion.

6. The cutting edge assembly of claim 5 wherein the rearward end surface located in the elongate slot of the mechanically attached adapter has a concave shape.

7. The cutting edge assembly of claim 6 wherein the concave shaped rearward end surface has a first generally flat surface beginning at the lower surface of the upper strap portion and extending upwardly and rearwardly toward the upper surface and a second surface extending from the first generally flat surface forwardly and upwardly toward the upper surface.

8. The cutting edge assembly of claim 7 wherein the concave shaped rearward end surface has a third surface extending from the second surface upwardly to the upper surface.

9. The cutting edge assembly of claim 8 wherein the retainer mechanism has a load transferring surface in mating engagement with the first generally flat surface of the concave shaped rearward end surface located in the elongate slot.

10. The cutting edge assembly of claim 9 wherein the first force transferring surface of the generally flat wedge has a plurality of notches disposed therealong in closely spaced relationship and the retainer mechanism has a removable clamp thereof for mating engagement with at least one notch of the plurality of notches.

11. The cutting edge assembly of claim 10 wherein the lower strap portion has a predetermined length that is less than one-half the length of the upper strap portion.

12. The cutting edge assembly of claim 11 wherein the stop member extends outwardly from the lower surface of the base edge.

13. The cutting edge assembly of claim 12 wherein a recess is defined in the lower strap portion adjacent the lower surface of the base edge and of a size sufficient to receive at least a portion of the stop member extending below the base edge.

14. A method of mounting a mechanically attached adapter to a base edge, said adapter having an upper strap portion with an elongate slot defined therein, a spaced apart bottom strap, and an intermediate portion interconnecting the upper strap portion and the lower strap portion to define a cavity to said base edge having a top surface, a leading edge, an elongate opening defined therein spaced from the leading edge, and a stop member solidly secured in the opening and extending outwardly from the top surface, comprising the following steps:

lowering the adapter over the stop member of the base edge to insert the stop member into the elongate slot;

sliding the mechanically attached adapter towards the leading edge to slip the base edge into the cavity;

inserting a retainer mechanism into the elongate slot spaced from the stop member and abutting one end of the elongate slot;

inserting a generally flat wedge into the elongate slot between the retainer mechanism and the stop member; and forcing the generally flat wedge into frictional engagement with the retainer mechanism and the stop member.

15. The method of claim 14 including the step of clamping the generally flat wedge in its frictionally engaged position.

16. The method of claim 14 wherein the step of inserting the generally flat wedge into the elongate slot also includes inserting the generally flat wedge into the elongate opening.

* * * * *